US008808616B2

(12) United States Patent
Simoes et al.

(10) Patent No.: US 8,808,616 B2
(45) Date of Patent: Aug. 19, 2014

(54) BUSTLE PIPE ARRANGEMENT

(75) Inventors: Jean-Paul Simoes, Walferdange (LU); Lionel Hausemer, Steinsel (LU); Manfred Moller, Wiesbaden-Auringen (DE); Paul Tockert, Berbourg (LU); Rudolf Hebel, Ginsheim-Gustavsburg (DE)

(73) Assignees: Paul Wurth Refractory & Engineering GmbH (DE); Paul Wurth S.A., Luxembourg (LU)

( * ) Notice: Subject to any disclaimer, the term of this patent is extended or adjusted under 35 U.S.C. 154(b) by 205 days.

(21) Appl. No.: 13/143,216

(22) PCT Filed: Dec. 16, 2009

(86) PCT No.: PCT/EP2009/067248

§ 371 (c)(1),
(2), (4) Date: Jul. 5, 2011

(87) PCT Pub. No.: WO2010/076211

PCT Pub. Date: Jul. 8, 2010

(65) Prior Publication Data

US 2011/0253017 A1 Oct. 20, 2011

(30) Foreign Application Priority Data

Jan. 5, 2009 (EP) ..... 09150054

(51) Int. Cl.

| | |
|---|---|
| ***C21B 7/16*** | (2006.01) |
| ***F27D 3/16*** | (2006.01) |
| ***F27B 1/16*** | (2006.01) |
| ***C21B 9/10*** | (2006.01) |
| ***F27B 1/10*** | (2006.01) |
| ***F27D 1/12*** | (2006.01) |

(52) U.S. Cl.

CPC ... *F27B 1/16* (2013.01); *F27D 3/16* (2013.01); *C21B 9/10* (2013.01); *C21B 7/163* (2013.01); *F27B 1/10* (2013.01); *F27D 1/12* (2013.01)

USPC ..... 266/265; 266/197; 110/182.5

(58) Field of Classification Search

USPC ..... 266/265, 280, 197; 75/466, 552, 551; 110/182.5

See application file for complete search history.

(56) References Cited

U.S. PATENT DOCUMENTS 2,087,842 A * 7/1937 Gerwig ..... 266/266
3,093,450 A * 6/1963 Luerssen et al. ..... 423/659

(Continued)

FOREIGN PATENT DOCUMENTS

CN 1485446 A 3/2004
DE 143520 C 8/1903

(Continued)

OTHER PUBLICATIONS

International Search Report and Written Opinion issued Aug. 16, 2010 by European Patent Office re: PCT/EP2009/067248; citing US4403951A, DE143520C, FR358645A, US2007137436A1, FR2094509A, DE3803576A1, CN1485446A, JP2005264223A and SU444803A1.

(Continued)

*Primary Examiner* — Scott Kastler
*Assistant Examiner* — Michael Aboagye
(74) *Attorney, Agent, or Firm* — Cantor Colburn LLP

(57) ABSTRACT

There is provided a bustle pipe arrangement of a shaft furnace that comprises a circumferential bustle pipe arranged along the outer casing of the shaft furnace, the bustle pipe being arranged at a certain distance from the outer casing. The arrangement further comprises a plurality of first arms connecting the bustle pipe to the outer casing of the shaft furnace on a first level; and a plurality of second arms connecting the bustle pipe to the outer casing of the shaft furnace on a second level, the first level being different from the second level. First and second blow channels are respectively arranged through the first and second arms for fluidly connecting the bustle pipe to the interior of the shaft furnace.

13 Claims, 2 Drawing Sheets

(56) References Cited

U.S. PATENT DOCUMENTS

| | | | | |
|---|---|---|---|---|
| 3,814,404 | A | 6/1974 | Claflin | |
| 4,285,504 | A * | 8/1981 | Colvin | 266/266 |
| 4,298,192 | A | 11/1981 | Barbakadze et al. | |
| 4,403,951 | A | 9/1983 | Beckenbach et al. | |
| 4,530,101 | A * | 7/1985 | Fey et al. | 373/19 |
| 4,753,283 | A * | 6/1988 | Nakano | 164/312 |
| 6,146,442 | A | 11/2000 | Sanford | |
| 2007/0137436 | A1 * | 6/2007 | Loffler | 75/466 |

FOREIGN PATENT DOCUMENTS

| | | | |
|---|---|---|---|
| DE | 3803576 | A1 | 8/1989 |
| FR | 358645 | * | 3/1906 |
| FR | 358645 | A | 3/1906 |
| FR | 2094509 | A | 2/1972 |
| JP | 11229007 | | 8/1999 |
| JP | 2005-264223 | A | 9/2005 |
| SU | 115334 | A | 11/1958 |
| SU | 444803 | A1 | 9/1974 |
| WO | 8605520 | A1 | 9/1986 |

OTHER PUBLICATIONS

JP. UM. 61-177569; JP.UM. 63-85648A; English Abstract; one page.
JP Patent Application No. P2011-544013; Office Action Mailed Nov. 6, 2013; English Translation; 7 pages.
JP. UM.354563 English Abstract; one page.
JP. UM. Application 51-88453; JP.UM.53-5502A; English abstract; one page.

* cited by examiner

BUSTLE PIPE ARRANGEMENT

TECHNICAL FIELD

The present invention generally relates to a bustle pipe arrangement, in particular for feeding pressurized hot gas to a shaft furnace.

BACKGROUND

In shaft furnaces, particularly in blast furnaces, pressurized hot gas, typically pressurized hot air, is blown into the furnace for aiding the reduction of ore in the shaft furnace.

Conventionally, a circumferential bustle pipe is arranged in the tuyere band around the outer casing of the shaft furnace, at a certain distance therefrom. The gas is fed from the bustle pipe through a tuyere stock row, where it is blown into the shaft furnace. A tuyere stock is generally provided with compensators for compensating for relative movement between the bustle pipe and the shaft furnace. Such a conventional bustle pipe arrangement is e.g. known from WO 86/05520.

It has been suggested to inject gas into the shaft furnace, not only at the upper hearth level, but also in a region above the melting zone, also referred to as the "lower shaft". Lower shaft injection necessitates a further bustle pipe arrangement for feeding gas to the individual injection points in the lower shaft.

The conventional bustle pipe arrangement, as described above, has been considered. Although such a solution has the obvious advantages of being a known and tested solution, it also has a number of drawbacks. Indeed, the considerable weight of this arrangement makes it difficult to arrange at the level of the lower shaft. Also, the cumbersome design of the conventional bustle pipe arrangement limits the number of injection points.

Another contender for a bustle pipe arrangement for injection at the lower shaft level is the so-called "Midrex"-type gas injection, which comprises a circumferential distribution channel built into the furnace wall, as illustrated by U.S. Pat. No. 6,146,442. This allows increasing the number of injection points. However, this solution is difficult to adapt to existing shaft furnaces and introduces some additional risks as to wear of the refractory material, in particular in the wall separating the distribution channel from the furnace chamber. A further non-negligible concern is the statics of the furnace. Indeed, the structure of the furnace is weakened by the "Midrex"-type construction.

BRIEF SUMMARY

The invention provides a bustle pipe arrangement of a shaft furnace wherein the above disadvantages are avoided.

The present invention proposes a bustle pipe arrangement of a shaft furnace, in particular for feeding pressurized hot gas into the shaft furnace, wherein the bustle pipe arrangement comprises a circumferential bustle pipe arranged along the outer casing of the shaft furnace, the bustle pipe being arranged at a certain distance form the outer casing. The arrangement further comprises a plurality of first arms connecting the bustle pipe to the outer casing of the shaft furnace on a first level; and a plurality of second arms connecting the bustle pipe to the outer casing of the shaft furnace on a second level, the first level being different from the second level. First and second blow channels are respectively arranged through the first and second arms for fluidly connecting the bustle pipe to the interior of the shaft furnace.

The first and second blow channels arranged through the first and second arms allow the injection of gas, hot air or reduction gas, into the shaft furnace on two separate levels. The more compact design of the bustle pipe arrangement also allows for the number of injection points to be considerably increased when compared to conventional bustle pipe arrangements. The increased number of injection points allows a more homogenous injection of gas into the shaft furnace. A further important advantage of the present bustle pipe arrangement is that it can be easily integrated on existing shaft furnaces, with minimal alterations to the shaft furnace.

According to a first embodiment of the invention, the first and second arms are configured to support the circumferential bustle pipe. Due to the plurality of first and second arms, configured as support arms, the bustle pipe arrangement is self-supporting; in fact the bustle pipe arrangement is supported directly on the wall of the shaft furnace and no frame construction is necessary to support the bustle pipe arrangement. Furthermore, as the bustle pipe is directly connected to the shaft furnace wall, compensators are not necessary. This lowers the risk of leakages between the bustle pipe and the shaft furnace.

According to a second embodiment of the invention, the circumferential bustle pipe is suspended from a framework. A framework, which may already be present anyway, may be used to suspend the bustle pipe therefrom. It should be noted that the suspension of the bustle pipe may also be used in combination with support arms as described above.

Advantageously, the bustle pipe comprises a refractory lining on its inner wall and the first and/or second blow channels extend through the refractory lining of the bustle pipe, thereby allowing gas from the bustle pipe gas channel to flow through the arms into the shaft furnace.

Preferably, the bustle pipe comprises access ports in wall portions opposite the first and/or second blow channels, in linear alignment with respective first and/or second blow channels. Such access ports allow servicing, cleaning, plugging and hot gas impulse regulation of the blow channels. The cleaning of the blow channels may become necessary after prolonged operation and is enabled through the access ports.

The access ports also allow the plugging of individual blow channels, thereby rendering the gas injection through the present bustle pipe arrangement particularly flexible. Indeed, a plunger may be associated with an access port for at least partially plugging a respective blow channel. The use of such a plunger allows the plugging of certain blow channels, thereby increasing the flow rate through the remaining blow channels. It may e.g. be desired to inject gas into the shaft furnace at one level. All of the blow channels of the other level are then plugged. The plunger may also have conical nose for allowing regulation of gas flow through a respective blow channel.

The access ports also provide access to injection nozzles, which may be removably installed in the blow channels, preferably in the end of the blow channels facing the shaft furnace. This allows replacing worn injection nozzles or exchanging injection nozzles of a particular inside diameter with injection nozzles of a different inside diameter. As an alternative nozzle, inserts may be inserted into the injection nozzles through the access ports. Such nozzle inserts would also change the inner diameter of the injection nozzle. The possibility to change the inside diameter of the injection nozzle allows the flow of hot gas through the blow channels to be adapted to particular operating conditions, thereby increasing the operational flexibility of the shaft furnace.

The injection nozzles and/or the nozzle inserts and/or the plunger are preferably made from a ceramic material, preferably an oxide ceramic material or a silicon infiltrated silicon carbide material. Such materials are chosen to withstand wear caused by the dust laden hot gas. Also, the inventors have found that with such materials, cooling of the injection nozzles and/or the nozzle inserts and/or the plunger is not necessary.

It should be noted that the use of injection nozzles, nozzle inserts or plungers as described above should not be limited to the use in connection with the above-mentioned bustle pipe arrangement.

Advantageously, the second arms are arranged so as to be, on a vertical projection, arranged half-way between two neighboring first arms, thereby optimizing the gas injection through achieving a more homogeneous repartition of the gas injected.

The first and/or second arms may be formed by a piece of piping, lined internally with refractory material and having the first and second blow channels passing therethrough. The piece of piping is advantageously a straight piece of piping. Such a straight piece of piping provides a direct connection between the bustle pipe and the interior of the shaft furnace, i.e. without bends, joints or connections. The pressure loss across the piece of piping can thereby be reduced.

According to one embodiment of the invention, the first arms may be essentially horizontal and the second arms may be inclined, e.g. at an angle of between 10 and 60° with respect to the horizontal.

According to a preferred embodiment of the invention, the second arms are arranged at an angle chosen such that access ports associated with the second blow channels are essentially on the same level as access ports associated with the first blow channels. The second arms may e.g. be arranged at an angle of about 45° with respect to the horizontal and an imaginary line between the second arm and its associated access port may pass through the centre of the bustle pipe. Arranging all access ports, i.e. those associated with both the first and second blow channels, on a same level allows for an easier and quicker servicing of the blow channels. Indeed, a single platform may be used to access both levels of injection points for servicing. Furthermore, it should also be noted that an increased angle provides an improved support for the bustle pipe arrangement.

According to another preferred embodiment of the invention, the first and second support arms are both inclined at an angle of between 0 and 40°, preferably between 0 and 30°, with respect to the horizontal.

The bustle pipe may have an essentially round or oval cross-section. It should be noted that other shaped of cross-section should not be excluded.

In case of an essentially oval cross-section, the bustle pipe is preferably dimensioned so as to have sufficient height clearance for allowing personal inspection of the interior of the bustle pipe, e.g. by a maintenance employee.

At least one plurality of auxiliary arms may be provided for connecting the bustle pipe to the outer casing of the shaft furnace, wherein auxiliary blow channels are arranged through the auxiliary arms for fluidly connecting the bustle pipe to the interior of the shaft furnace. Such auxiliary arms may be used to provide injection points on at least one auxiliary level.

BRIEF DESCRIPTION OF THE DRAWINGS

A preferred embodiment of the invention will now be described, by way of example, with reference to the accompanying drawings, in which.

DETAILED DESCRIPTION

Figure 1:
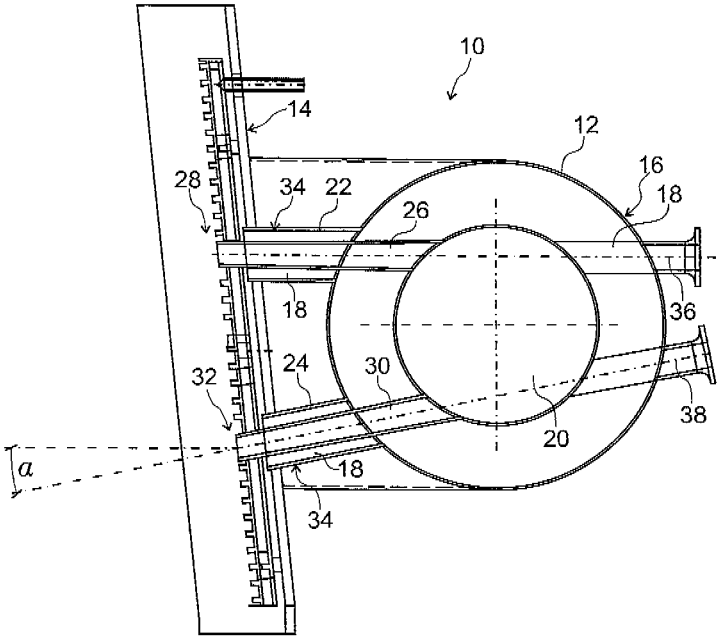
FIG. 1 is a schematic cross-sectional view through a bustle pipe arrangement according to the present invention.

The present invention is illustrated by referring to FIG. 1, which shows a bustle pipe arrangement, which is arranged around an outer casing of a shaft furnace.

The bustle pipe arrangement 10 comprises a bustle pipe 12, circumferentially arranged around a shaft furnace, a portion of an outer casing 14 of which is shown in FIG. 1. The bustle pipe 12 is arranged at a certain distance from the outer casing 14 and is formed by a pipe 16 of essentially round cross-section, which is internally lined with refractory material 18 within which a gas channel 20 is formed.

The bustle pipe 12 is maintained in place along the outer casing 14 of the shaft furnace by means of a plurality of first arms 22 and second arms 24, which are, according to a first embodiment of the invention, formed by support arms configured to support the bustle pipe 12. The first and second arms 22, 24 are therefore arranged on two separate levels all around the circumference of the shaft furnace and support the bustle pipe 12. The arms 22, 24 are preferably attached to the bustle pipe 12 and to the furnace wall 14 by welding.

It should be noted that, although not shown of the Figures, the bustle pipe 12 may, as an alternative to being supported on the outer casing 14 of the shaft furnace by means of the first and second arms 22, 24, be suspended from a framework (not shown). This second embodiment may allow the arms 22, 24 to be less strong and may make use of a framework already present anyway. A combination of both embodiments is naturally also possible.

First blow channels 26 are arranged through the first arms 22 for fluidly connecting the gas channel 20 of the bustle pipe 12 to the interior of the shaft furnace through first injection points 28. Similarly, second blow channels 30 are arranged through the second arms 24 for fluidly connecting the gas channel 20 of the bustle pipe 12 to the interior of the shaft furnace through second injection points 32. The bustle pipe arrangement 10 according to the present invention therefore allows injection of gas into the shaft furnace on two levels. This increases the number of injection points and allows for a more homogenous repartition of the gas injected. The number of injection points obviously depends on the diameter of the shaft furnace, the diameter of the injection points and the distance between neighboring injection points. For a shaft furnace having e.g. a hearth diameter of about 7 m, the number of injection points may be as high as 100.

The first and second arms 22, 24 each comprise a piece of piping 34, internally lined with refractory material 18, the first and second blow channels 26, being formed therethrough. In the embodiment shown in FIG. 1, the first arms 22 are arranged essentially horizontally and the second arms 24 are arranged at an angle $\alpha$ of between 10 and 15° with respect to the horizontal. Although not shown in the Figures, an angle $\alpha$ of about 45° may be preferred.

The bustle pipe arrangement 10 further comprises a first access port 36 associated with each first blow channel 26 and a second access port 38 associated with each second blow channel 30. The first and second access ports 36, 38 are arranged in linear alignment of the first and second blow channels 26, 30. These access ports allow servicing, cleaning, plugging and hot gas impulse regulation of the respective blow channels 26, 30. The plugging of individual blow channels 26, 30 provides an important degree of flexibility to the operation of the gas injection through the present bustle pipe arrangement 10. The end of the blow channels 26, 30 facing the shaft furnace may be provided with injection nozzles (not shown). Such injection nozzles may easily be replaced or exchanged through the access ports 36, 38. The injection nozzles may e.g. be replaced with injection nozzles having different outlet diameter, thereby further contributing to the flexibility of the present bustle pipe arrangement 10.

Figure 2:
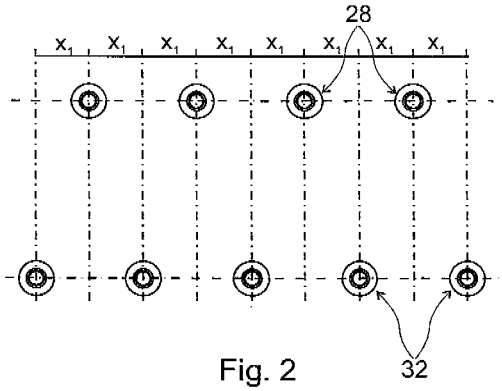
FIG. 2 is a schematic illustration of the injection points of the bustle pipe arrangement according to the present invention.

It should further be noted that, as illustrated on FIG. 2, the first and second arms 22, 24 are arranged in such a way that the second injection points 32 are located half-way between neighboring first injection points 28. Such a staggered arrangement of the injection points 28, 32 warrants a more homogenous repartition of the gas injected into the shaft furnace.

Figure 3:
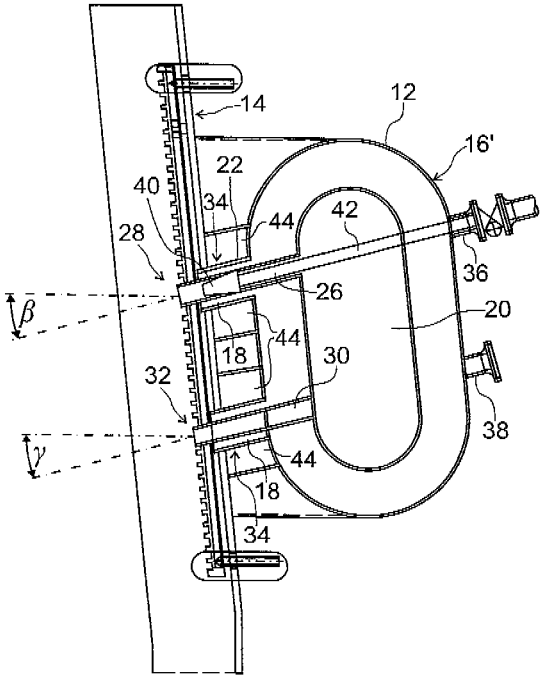
FIG. 3 is a schematic cross-sectional view through a bustle pipe arrangement according to a further embodiment of the present invention.

FIG. 3 shows a further embodiment of a blowpipe arrangement according to the present invention. Similarly to the embodiment of FIG. 1, the bustle pipe arrangement 10 comprises a bustle pipe 12, circumferentially arranged around a shaft furnace. The bustle pipe 12 is however formed by a pipe 16' of essentially oval cross-section. The bustle pipe 12 is dimensioned so as to have sufficient height clearance for allowing personal inspection of the interior of the bustle pipe 12. The first support arms 22 may be arranged at an angle $\beta$ of between 0 and 40° with respect to the horizontal. Similarly, the support arms 24 may be arranged at an angle $\gamma$ of between 0 and 40° with respect to the horizontal. In FIG. 3 both support arms 22, 24 are arranged at an angle of about $\beta=\gamma=10$ to 15°. It should however be noted that $\beta$ and $\gamma$ are not necessarily equal.

FIG. 3 also shows an injection nozzle 40 arranged in the first blow channel 26. Such injection nozzles 40 can be removed and replaced through the access ports 36, 38 associated to the respective blow channels 26, 30.

FIG. 3 further shows a plunger 42 associated with the first blow channel 26. Such a plunger 42 may be used to either plug the first blow channel 26 or to regulate the flow of hot gas therethrough.

In order to strengthen the connection, reinforcement fins 44 may further be provided between the pipe 16 and the outer casing 14, as shown in FIG. 3. Such reinforcement fins 44 may be made of a thick metal sheet welded to the piece of piping 34, the pipe 16 and the outer casing 14. The reinforcement fins 44 extend in a vertical direction, radially away from the piece of piping 34.

The invention claimed is:

1. Bustle pipe arrangement of a shaft furnace comprising:

a circumferential bustle pipe arranged along an outer casing of said shaft furnace, said bustle pipe being arranged at a certain distance from said outer casing;

a plurality of first arms connecting said bustle pipe to said outer casing of said shaft furnace on a first level; first blow channels being arranged through said first arms for fluidly connecting said bustle pipe to an interior of said shaft furnace; and a plurality of second arms connecting said bustle pipe to said outer casing of said shaft furnace on a second level; second blow channels being arranged through said second arms for fluidly connecting said bustle pipe to the interior of said shaft furnace, said first level being different from said second level, wherein said bustle pipe comprises access ports located in wall portions of the bustle pipe and opposite to said first and/or second blow channels, in linear alignment with respective first and/or second blow channels, and wherein said first arms are essentially horizontal and wherein said second arms are inclined at an angle of between 10 and 60° with respect to the horizontal.

2. Bustle pipe arrangement according to claim 1, wherein said first and second arms are configured to support said circumferential bustle pipe.

3. Bustle pipe arrangement according to claim 1, wherein said bustle pipe comprises a refractory lining on an inner wall and wherein said first and/or second blow channels extend through said refractory lining of said bustle pipe.

4. Bustle pipe arrangement according to claim 1, wherein a plunger is associated with an access port for at least partially plugging at least one of said first blow channels and second blow channels.

5. Bustle pipe arrangement according to claim 4, wherein said plunger has a conical nose for allowing regulation of gas flow through at least one of said first blow channels and second blow channels.

6. Bustle pipe arrangement according to claim 1, wherein an injection nozzle and/or an injection nozzle insert is removably arranged in at least one of the first blow channels and the second blow channels.

7. Bustle pipe arrangement according to claim 1, wherein said second arms are arranged so as to be, on a vertical projection, arranged half-way between two neighboring first arms.

8. Bustle pipe arrangement according to claim 1, wherein said first and/or second arms are formed by a straight piece of piping lined internally with refractory material and having said first and second blow channels passing therethrough.

9. Bustle pipe arrangement according to claim 1, wherein said second arms are arranged at an angle chosen such that access ports associated with said second blow channels are essentially on the same level as access ports associated with said first blow channels.

10. Bustle pipe arrangement according to claim 1, wherein said first and second support arms are both inclined at an angle of between 0 and 40° with respect to the horizontal.

11. Bustle pipe arrangement according to claim 1, further comprising at least one plurality of auxiliary arms connecting said bustle pipe to said outer casing of said shaft furnace, wherein auxiliary blow channels are arranged through said auxiliary arms for fluidly connecting said bustle pipe to the interior of said shaft furnace.

12. Bustle pipe arrangement according to claim 1, wherein said bustle pipe has an essentially round or oval cross-section.

13. Bustle pipe arrangement according to claim 4, wherein said plunger comprises an oxid-ceramic material or a silicon infiltrated silicon carbide material.

* * * * *